US005727843A

United States Patent [19]

LaTrace

[11] Patent Number: 5,727,843

[45] Date of Patent: Mar. 17, 1998

[54] COMFORT COMBINATION CHAIR

[75] Inventor: Barbara J. LaTrace, Rte. 2, Box. 169, Norfolk, N.Y. 13667

[73] Assignee: Barbara J. LaTrace, Norfolk, N.Y.

[21] Appl. No.: 662,634

[22] Filed: Jun. 13, 1996

Related U.S. Application Data

[63] Continuation of Ser. No. 326,393, Sep. 20, 1994, abandoned.

[51] Int. Cl.[6] ..... A47C 15/00

[52] U.S. Cl. ..... 297/188.13; 297/188.1

[58] Field of Search ..... 297/188.01, 188.1, 297/188.11, 188.13

[56] References Cited

U.S. PATENT DOCUMENTS

| | | | |
|---|---|---|---|
| 75,778 | 3/1868 | Macferran | 297/188.13 X |
| 247,593 | 3/1881 | Steele | D6/26 |
| 254,999 | 5/1882 | Dieter et al. | D6/42 |
| 410,591 | 9/1889 | Hofmann | 297/188.13 X |
| 638,894 | 12/1899 | Voss | 297/188.13 X |
| 1,362,444 | 12/1920 | Specher | 297/188.13 X |
| 1,370,176 | 3/1921 | Wollan | 297/188.13 X |
| 1,822,638 | 9/1931 | Aiello | 297/188.01 |
| 3,213,467 | 10/1965 | Hubbard | 297/188.13 X |
| 3,769,638 | 11/1973 | Clanan | 4/134 |
| 3,860,285 | 1/1975 | Hartman | 297/150 |
| 5,139,309 | 8/1992 | Korneich | 297/194 |

*Primary Examiner*—Peter R. Brown
*Attorney, Agent, or Firm*—Michael Colitz

[57] ABSTRACT

A comfort combination chair comprising a seating portion positionable in an essentially horizontal plane; a plurality of legs extending downwardly from the four corners of the seating area and secured at their upper ends to the lower surface of the seating portion and having at their lower ends four wheels in a rectangular configuration with axles for the rotation of the wheels; a housing secured to the upper extents of the legs and secured immediately beneath the lower surface of the seating area, the housing area having a door with hinges rotatable about a vertical axis to allow the door to be opened and closed for the storage of components; a pair of arm rests located above the upper surface of the seating area adjacent to the side edges thereof, the arm rests having a horizontal surface with padding for the receipt of the arms of a user and having downwardly extending vertical supports; a back support having a rectangular configuration, the lower edge of the back support being rotatably coupled to the rear edge of the seating area; and a foot rest extending outwardly and downwardly at an angle, from the front edge of the seat support with the inboard edge pivotally secured to the seating area adjacent to the forward edge thereof.

4 Claims, 4 Drawing Sheets

COMFORT COMBINATION CHAIR

This application is a continuation of application Ser. No. 08/326,393, filed Sep. 20, 1994, now abandoned.

BACKGROUND OF THE INVENTION

1. Field of the Invention

The present invention relates to a comfort combination chair and more particularly pertains to maximizing the comfort and convenience of people utilizing a chair system with extended features to promote safety, comfort and utility.

2. Description of the Prior Art

The use of chairs of a wide variety of designs and configurations is known in the prior art. More specifically, chairs of a wide variety of designs and configurations heretofore devised and utilized for the purpose of providing a seating surface for occupants with additional features constructed of a wide variety of apparatuses and methods are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,769,638 a combination wheel chair and commode chair.

U.S. Pat. No. 3,860,285 discloses a combined wheelchair, tray and foot rest.

U.S. Pat. No. 5,139,309 discloses a combined wheelchair and tray assembly.

U.S. Pat. No. Des. 247,593 discloses the design of a shower bath chair.

U.S. Pat. No. Des. 254,999 discloses the design of a combined chair and tray for the handicapped.

In this respect, the comfort combination chair according to the present invention substantially departs from the conventional concepts and designs of the prior art, and in doing so provides an apparatus primarily developed for the purpose of maximizing the comfort and convenience of people utilizing a chair system with extended features to promote safety, comfort and utility.

Therefore, it can be appreciated that there exists a continuing need for a new and improved comfort combination chair which can be used to maximize the comfort and convenience of people utilizing a chair system with extended features to promote safety, comfort and utility. In this regard, the present invention substantially fulfills this need.

SUMMARY OF THE INVENTION

In view of the foregoing disadvantages inherent in the known types of chairs of a wide variety of designs and configurations now present in the prior art, the present invention provides an improved comfort combination chair. As such, the general purpose of the present invention, which will be described subsequently in greater detail, is to provide a new and improved comfort combination chair and method which has all the advantages of the prior art and none of the disadvantages.

To attain this, the present invention essentially comprises a new and improved comfort combination chair comprising, in combination, a seating portion positionable in an essentially horizontal plane and having a front edge, a rear edge, a left side edge and a right side edge; a plurality of legs extending downwardly from the four corners of the seating area and secured at their upper ends to the lower surface of the seating portion and having at their lower ends four wheels in a rectangular configuration with axles for the rotation of the wheels to facilitate movement of the chair; a housing secured to the upper extents of the legs and secured immediately beneath the lower surface of the seating area, the housing area having a door with hinges rotatable about a vertical axis to allow the door to be opened and closed for the storage of components including a potty; a supplemental horizontal plate positioned between the legs adjacent the lower extents thereof and above the wheels to provide additional stability to the legs; a pair of arm rests located above the upper surface of the seating area adjacent to the side edges thereof, the arm rests having a horizontal surface with padding for the receipt of the arms of a user and having downwardly extending vertical supports at their front ends and rear ends; a back support having a rectangular configuration having an upper, lower edge and side edges, the lower edge of the back support being rotatably coupled to the rear edge of the seating area to vary the angle of recline of the back of a user during operation and use; a seat belt formed of two components, the components having exterior edges secured to the side edges of the support adjacent to the rear edge, the components having interior edges with buckling components for releasable securement around the waist of a user; a foot rest extending outwardly and downwardly at an angle, from the front edge of the seat support, the foot and leg rest having an outboard edge, an inboard edge and side edges with the inboard edge pivotally secured to the seating area adjacent to the forward edge thereof; a supplemental tray secured to the left side edge and extending outwardly therefrom in a horizontal orientation, the supplemental support tray having a forward edge, a rearward edge, an outward edge and an inward edge with the inward edge fixedly secured with respect to the left edge of the seat support but at a lower elevation with respect thereto; a supplemental seating area in a rectangular configuration having a forward edge, a rearward edge, a right edge and a left edge, the supplemental seating area being pivotally secured to the seating surface adjacent to its rearward edge and adapted when in the down position to conceal a toilet hole in the seating area, the supplemental seating area adapted to be pivoted to a raised position to allow exposure of the seating hole; and a tray in a rectangular configuration having a forward edge, a rearward edge and side edges with recesses formed beneath the lower surfaces of the side edges adapted to be received on the arm rests of the chair, the upper surface of the tray having a plurality of recesses for the receipt of cups, bowls, plates and the like as a function and desire of the user.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved comfort combination chair which has all the advantages of the prior art chairs of a wide variety of designs and configurations and none of the disadvantages.

It is another object of the present invention to provide a new and improved comfort combination chair which may be easily and efficiently manufactured and marketed.

It is further object of the present invention to provide a new and improved comfort combination chair which is durable and reliable constructions.

An even further object of the present invention is to provide a new and improved comfort combination chair which is susceptible of a low cost of manufacture with regard to both materials and labor, and which accordingly is then susceptible of low prices of sale to the consuming public, thereby making such comfort combination chair economically available to the buying public.

Still yet another object of the present invention is to provide a new and improved comfort combination chair which provides in the apparatuses and methods of the prior art some of the advantages thereof, while simultaneously overcoming some of the disadvantages normally associated therewith.

Still another object of the present invention is to maximize the comfort and convenience of people utilizing a chair system with extended features to promote safety, comfort and utility.

Lastly, it is an object of the present invention to provide a new and improved comfort combination chair comprising a seating portion positionable in an essentially horizontal plane; a plurality of legs extending downwardly from the four corners of the seating area and secured at their upper ends to the lower surface of the seating portion and having at their lower ends four wheels in a rectangular configuration with axles for the rotation of the wheels; a housing secured to the upper extents of the legs and secured immediately beneath the lower surface of the seating area, the housing area having a door with hinges rotatable about a vertical axis to allow the door to be opened and closed for the storage of components; a pair of arm rests located above the upper surface of the seating area adjacent to the side edges thereof, the arm rests having a horizontal surface with padding for the receipt of the arms of a user and having downwardly extending vertical supports; a back support having a rectangular configuration, the lower edge of the back support being rotatably coupled to the rear edge of the seating area; and a foot rest extending outwardly and downwardly at an angle, from the front edge of the seat support with the inboard edge pivotally secured to the seating area adjacent to the forward edge thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
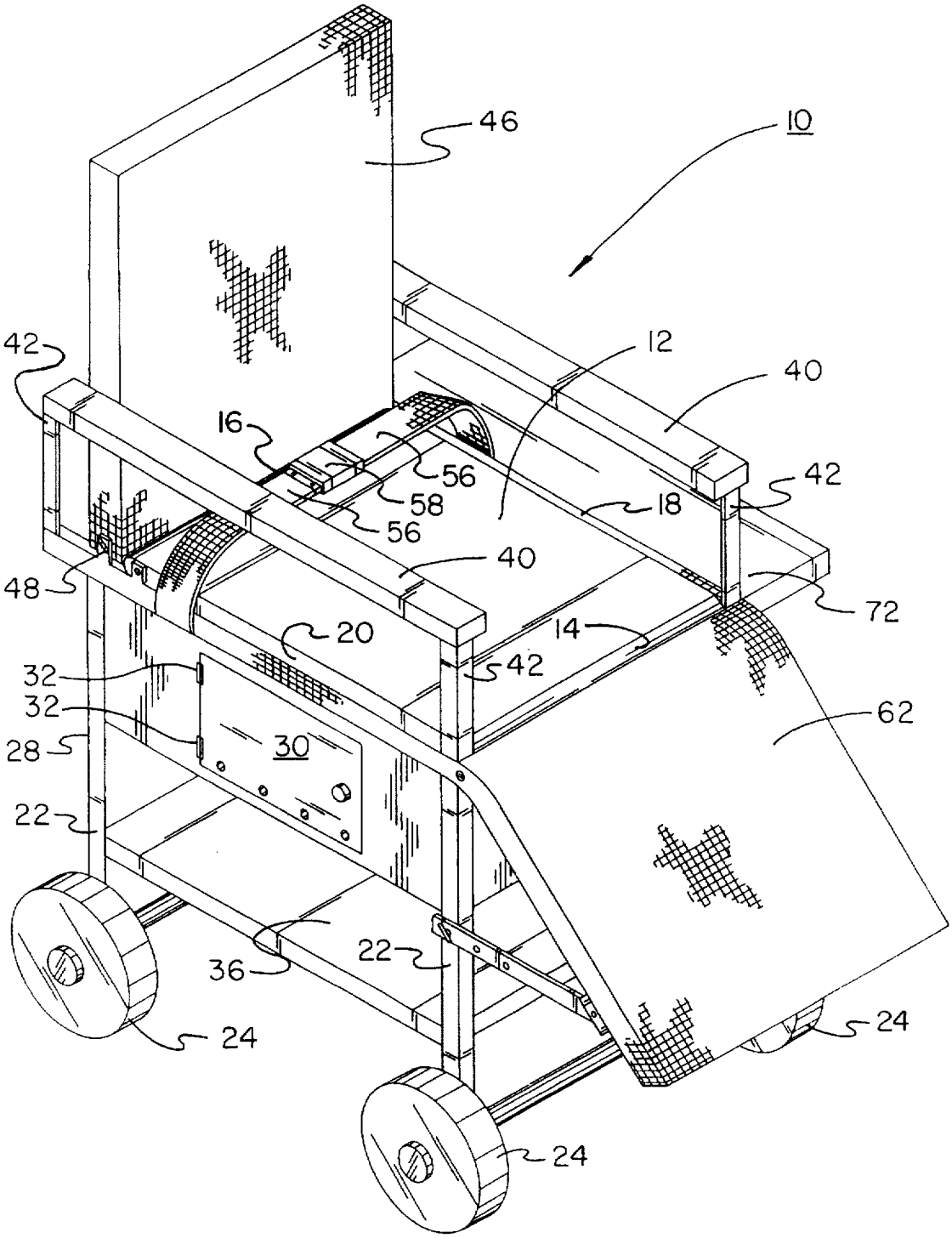
FIG. 1 is a perspective view of the preferred embodiment of the new and improved comfort combination chair constructed in accordance with the principles of the present invention.
Figure 2:
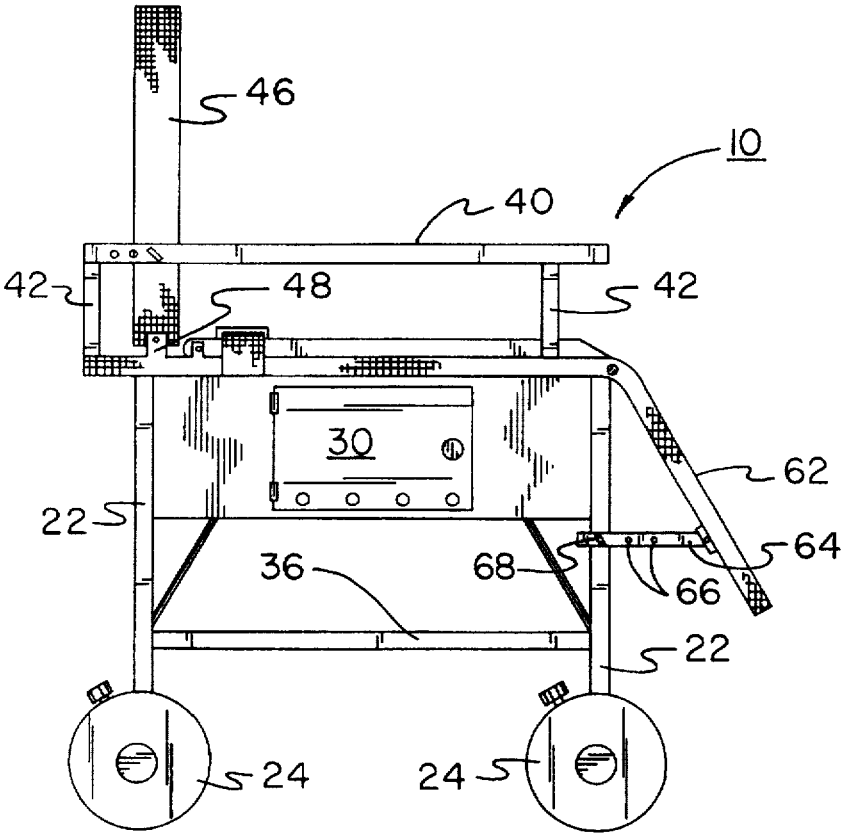
FIG. 2 is a right side elevational view of the chair shown in FIG. 1.
Figure 3:
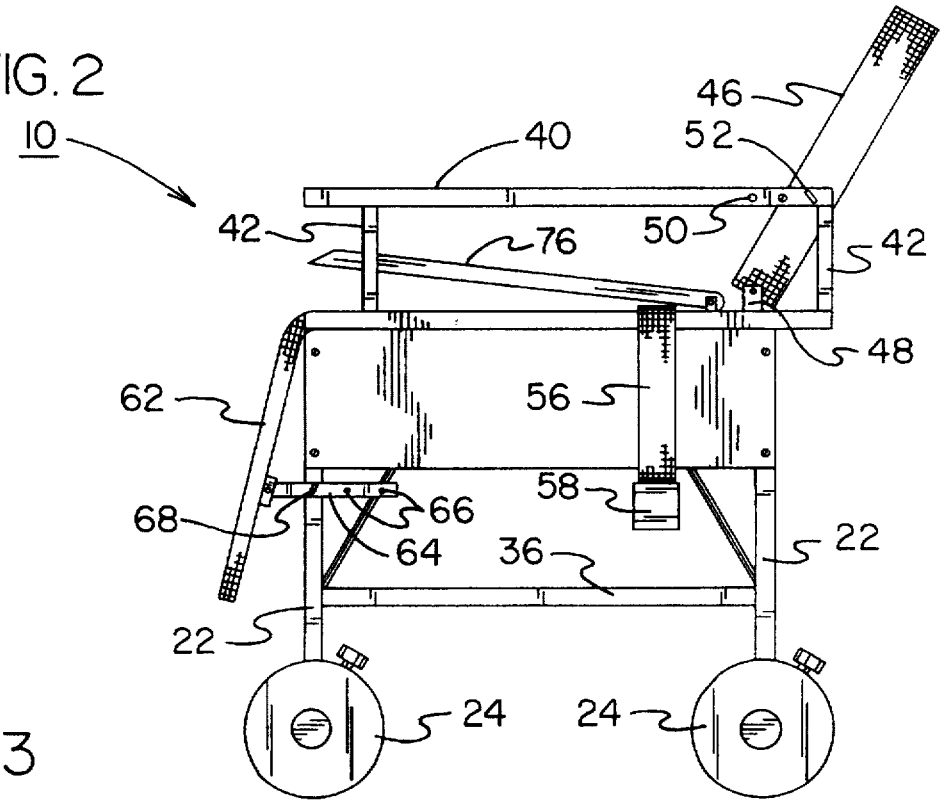
FIG. 3 is a left side elevational view of the chair sown in FIGS. 1 and 2 but with the back in an inclined configuration.
Figure 4:
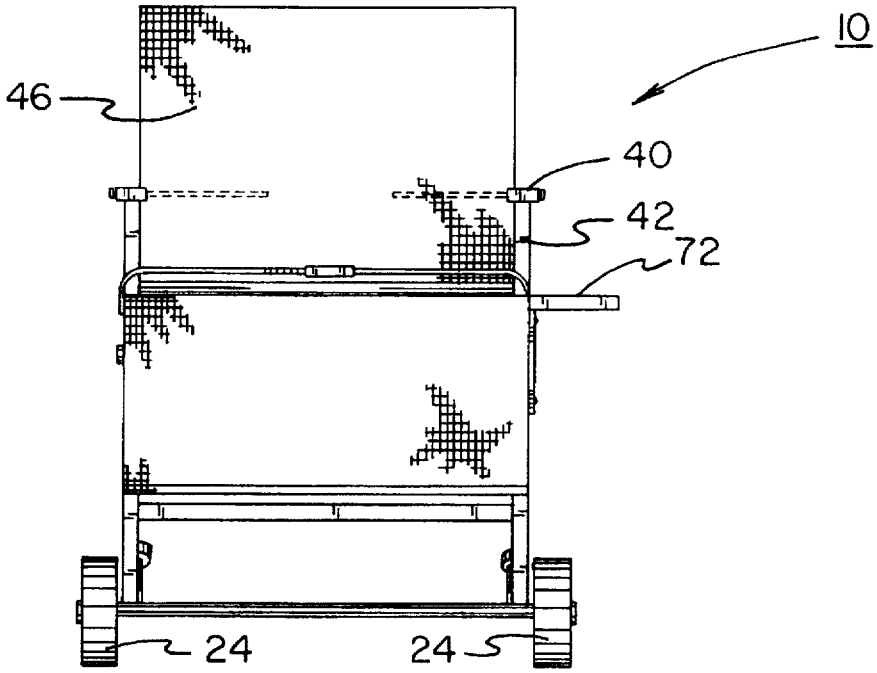
FIG. 4 is a rear elevational view of the chair shown in the prior Figure.
Figure 5:
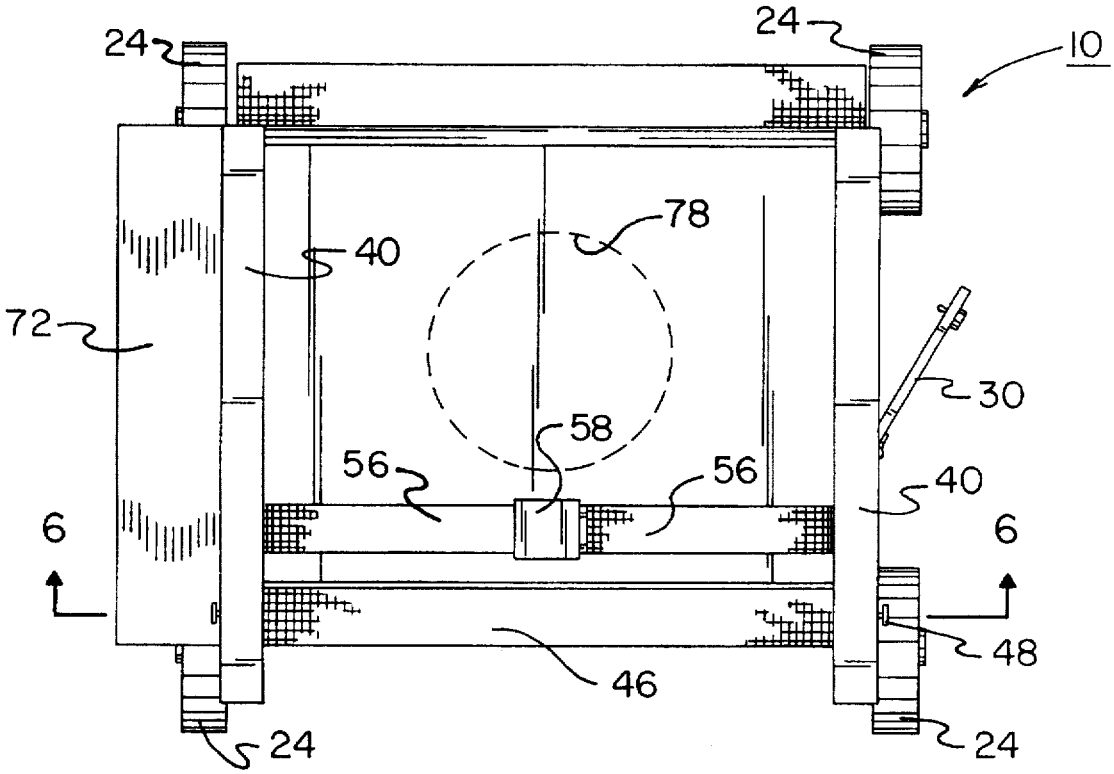
FIG. 5 is a top elevational view oft the chair shown in the prior Figure.
Figure 6:
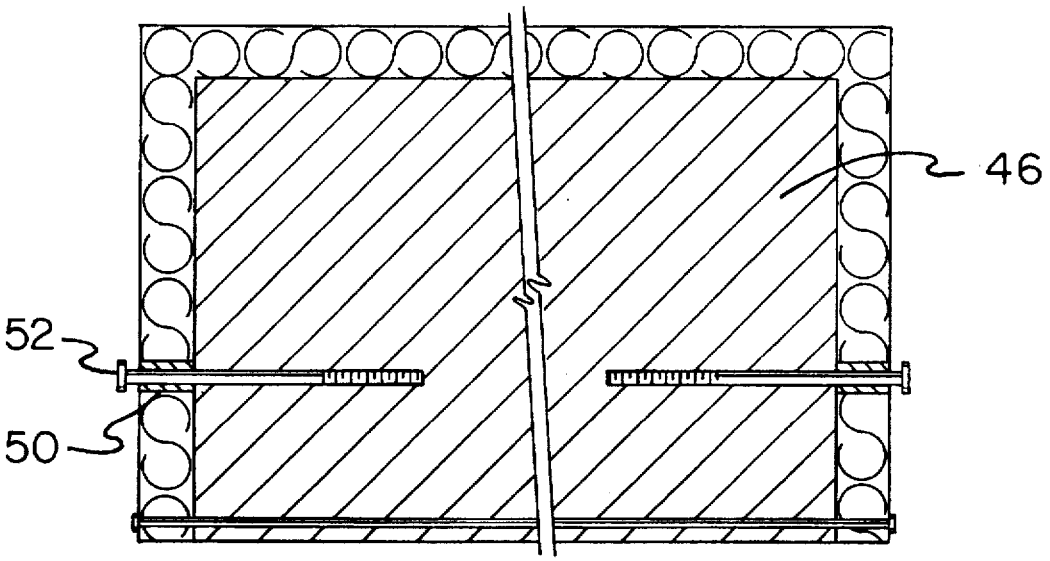
FIG. 6 is a cross-sectional view taken along line 6—6 of FIG. 5.
Figure 7:
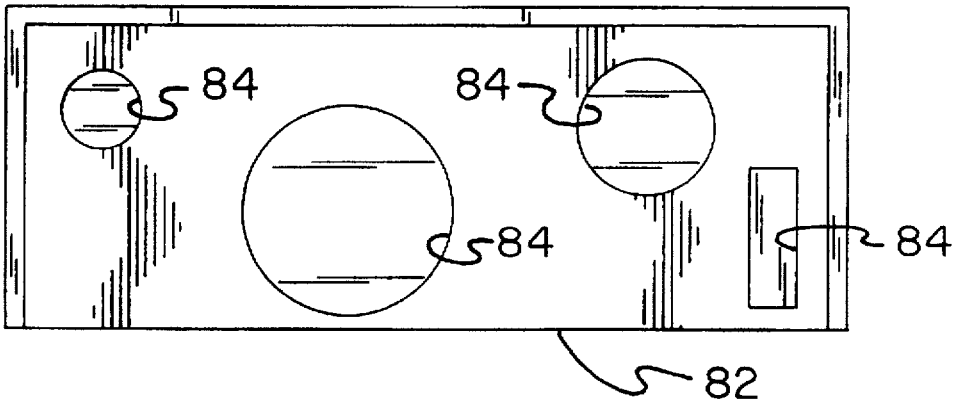
FIG. 7 is a top elevational view of a tray adapted to be used in association with the chair of the prior Figure.
Figure 8:
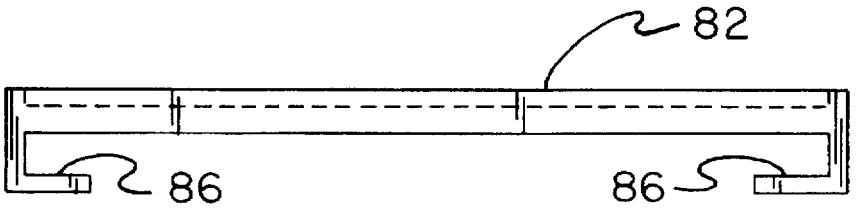
FIG. 8 is an end elevational view of the try shown in FIG. 7.

With reference now to the drawings, and in particular to FIG. 1 thereof, the preferred embodiment of the new and improved comfort combination chair, embodying the principles and concepts of the present invention and generally designated by the reference numeral 10 will be described.

The present invention, the new and improved comfort combination chair, is a system 10 comprised of a plurality of components. Such components, in their broadest context, include a seating portion, legs, a housing, a supplemental horizontal plate, a pair of arm rests, a back support, a seat belt, a foot rest, a supplemental tray, a supplemental seating area and a tray. Each of the individual components is specifically configured and correlated one with respect to the other so as to attain the desired objectives.

The present invention, the new and improved comfort combination chair, is a system 10 which has as its central component, a seating portion 12. The seating portion is positionable in an essentially horizontal plane. It has a front edge 14 and a rear edge 16. It also has a left side edge 18 and a right side edge 20. The edges are all in an essentially rectangular configuration.

Next provided are a plurality of legs 22. The legs extend downwardly from the four corners of the seating area. They are secured at their upper ends to the lower surface of the seating portion. They are provided at their lower ends with wheels 24. There are four such wheels in a rectangular configuration. The wheels are mounted on axles for rotation of the wheels to facilitate movement of the chair.

Next provided is a housing 28. The housing is secured at its upper extents to the legs and secured intermediately beneath the lower surface of the seating area. The housing is provided with a door 30. The door is pivotable on hinges 32 for being rotatable about a vertical axis. This is to allow the door to be opened and closed. The opening thus provides access for storage of components including a potty.

A horizontal plate 36 is next provided. Such plate is positioned between the legs adjacent to their lower extents. It is located above the wheel. It provides additional stability to the legs.

A pair of arm rests 40 are located above the upper surface of the seating area. Such arms are adjacent to the side edges of the seating area. The arm rests have horizontal surfaces and are provided with padding for the receipt of the arms of a user. The padding adds comfort during operation and use. The arm rests have downwardly extending vertical supports 42. Such supports are located at the front ends and rear ends of each arm rest.

Additional comfort is provided to the user through a back support 46. The back support is in a generally rectangular configuration. It has upper and lower edges. It also has side edges. The lower edge of the back support is rotatably coupled through pins 48 to the seating area adjacent to its rear edge. This arrangement is provided to allow varying the angle of recline of the back for the maximum comfort of a user during operation and use.

As is required with certain patients, a seat belt 56 is coupled with respect to the chair. It is formed of two components. The components have exterior edges secured at their side edges to the support. This is adjacent to the rear edge of the support. The two components have interior edges with buckling components 58. This is for allowing the releasable securement of the belt around the waist of a user. Additional safety is thus provided as may be required.

A foot rest 62 extends outwardly and downwardly at an angle from the seating area. This is from the front edge of the seat support. The foot and leg rest has an outboard edge. It also has an associated inboard edge and side edges. The inboard edge is pivotally secured to the seating area adjacent to the forward edge thereof. In the disclosed embodiment, a bar 64 is provided with holes 66. Movement of the holes with respect to each other allows varying the angle of the support. A pin 68 retains the holes in proper relation one with respect to the other to maintain the angle at the desired orientation.

Next provided is a supplemental tray 72. Such tray is secured to the left side edge and extends outwardly therefrom in a horizontal orientation. The supplemental support tray has a forward edge. It also has a rearward edge in addition to an outward edge and an inward edge. The inward edge is fixedly secured with respect to the left edge of the seat support. It is, however, at a lower angle with respect thereto.

A supplemental seating area 76 is also employed. It is in a rectangular configuration with a forward edge, a trailing edge, a right edge and a left edge. The supplemental seating area is pivotally secured by a pin 78 to the seating surface. This is at a region adjacent to its rearward edge. The supplemental seating area is adapted, when in the down position, to conceal a toilet hole 80. Such hole is preferably formed in the primary seating area. The supplemental seating area is adapted to be pivoted to a raised position to allow exposure of the seating hole, and the potty therebeneath, when needed by a user.

The last component of the system is a tray 82. The tray has an upper surface in a rectangular configuration. It also has a forward edge, a rearward edge, and side edges therebetween. Recesses 86 are formed beneath the lower surfaces of the side edges. This is by a wrap-around effect at the edges of the tray. Such recesses are adapted to be received on the arm rests of a chair. In the preferred mode, the upper surface of the tray has a plurality of recesses 84. Such recesses are for the receipt of cup, bowls, plates and the like as a function of the desire of the user.

The present invention is used for many purposes by patients, people who are handicapped, or are very old and feeble. It serves as a shower chair, toilet chair, and a chair for geriatric purposes. It has wheels which allow it to be moved easily, and clocks to prevent it from moving when they are engaged. It has a foot rest which extends down to a location between the shin and ankle. It also features an adjustable, three-position back. The user is secured in place with a wide safety belt which buckles together, or is joined with hook-and-loop fasteners at the ends.

When the present invention is used as a toilet, a detachable privacy compartment is placed around it. A potty is hidden in a compartment under the seat, which is lifted up when the unit is to be used. The compartment is well vented through numerous air holes.

All cushions are filled with materials which will readily conform to the contours of the body, and are completely washable. A small rack is provided on one side for books, as well as shampoos, soaps, etc. for use when showering. A sturdy tray featuring recessed compartments to keep plates, cups, etc. in place, can be snapped into place or lowered down on hinges. The outer edges have raised rims to prevent anything from sliding off. Side guards can be added for those people who need such assistance. Any pillows which are placed in the chair are held in place with snaps so they cannot fall out.

The present invention is ideal for hospitals, rehabilitation centers, and nursing homes. The chairs avoid disruptions to the patient, and make daily life and routines much simpler for them, and their care providers.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved comfort combination chair comprising, in combination:

a seating portion positionable in an essentially horizontal plane and having a front edge, a rear edge, a left side edge and a right side edge, the seating portion having four corners formed by adjacent edges being connected by all edges being in an essentially rectangular configuration;

a plurality of legs extending downwardly from the four corners of the seating area and secured at their upper ends to the lower surface of the seating portion and having at their lower ends four wheels in a rectangular configuration with axles for the rotation of the wheels to facilitate movement of the chair;

a housing secured to the upper extents of the legs and secured immediately beneath the lower surface of the seating area, the housing area having a door with hinges rotatable about a vertical axis to allow the door to be opened and closed for the storage of components including a potty;

a supplemental horizontal plate positioned between the legs adjacent the lower extents thereof and above the wheels to provide additional stability to the legs;

a pair of arm rests located above the upper surface of the seating area adjacent to the side edges thereof, the arm rests having a horizontal surface with padding for the receipt of the arms of a user and having downwardly extending vertical supports at their front ends and rear ends;

a back support having a rectangular configuration having an upper, lower edge and side edges, the lower edge of the back support being rotatably coupled through pins to the rear edge of the seating area to vary the angle of recline of the back of a user during operation and use;

a seat belt formed of two components, the components having exterior edges secured to the side edges of the support adjacent to the rear edge, the components having interior edges with buckling components for releasable securement around the waist of a user;

a foot rest extending outwardly and downwardly at an angle, from the front edge of the seat support, the foot and leg rest having an outboard edge, an inboard edge and side edges with the inboard edge pivotally secured to the seating area adjacent to the forward edge thereof;

a supplemental tray secured to the left side edge of the seat support and extending outwardly therefrom in a horizontal orientation, the supplemental support tray having a forward edge, a rearward edge, an outward edge and an inward edge with the inward edge fixedly secured with respect to the left edge of the seat support but at a lower elevation with respect thereto;

a supplement seating area in a rectangular configuration having a forward edge, a rearward edge, a right edge and a left edge, the supplemental seating area being pivotally secured to the seating surface adjacent to its rearward edge and adapted when in the down position to conceal a toilet hole in the seating area, the supplemental seating area adapted to be pivoted to a raised position to allow exposure of the seating hole; and a tray in a rectangular configuration having a forward edge, a rearward edge and side edges with recesses formed beneath the lower surfaces of the side edges adapted to be received on the arm rests of the chair, the upper surface of the tray having a plurality of recesses for the receipt of cups, bowls, plates and the like as a function and desire of the user.

2. A comfort combination chair comprising:

a seating portion positionable in an essentially horizontal plane and having a plurality of edges therearound;

a plurality of legs extending downwardly from four corners of the seating area formed at the edges and secured at their upper ends to the lower surface of the seating portion and having at their lower ends four wheels in a rectangular configuration with axles for the rotation of the wheels;

a housing secured to the upper extents of the legs and secured immediately beneath the lower surface of the seating area, the housing area having a door with hinges rotatable about a vertical axis to allow the door to be opened and closed for the storage of components;

a pair of arm rests located above the upper surface of the seating area adjacent to the side edges thereof, the arm rests having a horizontal surface with padding for the receipt of the arms of a user and having downwardly extending vertical supports;

a back support having a rectangular configuration having an upper, lower edge and side edges, the lower edge of the back support being rotatably coupled through pins to the rear edge of the seating area;

a seat belt formed of two components, the components having exterior edges secured to the side edges of the support adjacent to the rear edge, the components having interior edges with buckling components for releasable securement around the waist of a user;

a foot rest extending outwardly and downwardly at an angle, from the front edge of the seat support with the inboard edge pivotally secured to the seating area adjacent to the forward edge thereof;

a supplement seating area in a rectangular configuration having a forward edge, a rearward edge, a right edge and a left edge, the supplemental seating area being pivotally secured to the seating surface adjacent to its rearward edge and adapted when in the down position to conceal a toilet hole in the seating area, the supplemental seating area adapted to be pivoted to a raised position to allow exposure of the seating hole; and a tray in a rectangular configuration having a forward edge, a rearward edge and side edges with recesses formed beneath the lower surfaces of the side edges adapted to be received on the arm rests of the chair, the upper surface of the tray having a plurality of recesses for the receipt of cups, bowls, plates and the like as a function and desire of the user.

3. A chair for handicapped and feeble patients comprising:

a seating portion positionable in an essentially horizontal plane with a toilet hole formed therein;

a plurality of legs extending downwardly from the seating portion and a wheel at the lower ends of each leg;

a housing secured adjacent to the upper extents of the legs and secured beneath the lower surface of the seating area;

a pair of arm rests located above the upper surface of the seating portion adjacent to the side edges thereof said armrests each including front and rear supports fixed to said seating portion;

a back support having an upper edge and a lower edge and side edges, the lower edge of the back support being rotatably coupled to the rear edge of the seating portion said armrests each including front and rear supports fixed to said seating portion;

a seat belt formed of two components attached to the seating portion with separable elements for releasable securement around the waist of a user;

a foot rest extending from, and pivotally connected to, the front edge of the seat portion with adjustment components coupling a lower surface of the foot rest and the legs;

a supplement seating member in a rectangular configuration having a forward edge and a rearward edge and side edges, the supplemental seating member being pivotally secured to the seating portion adjacent to its rearward edge and adapted when in a down position to conceal the toilet hole and adapted when in a raised position to allow exposure of the toilet hole; and a tray in a generally rectangular configuration adapted to be received on the arm rests of the chair.

4. The chair as set forth in claim 3 and further including a plurality of recesses of varying sizes and configurations formed in the tray for the receipt of cups, bowls, plates and the like as a function and desire of the user.

* * * * *